United States Patent [19]

Vines et al.

[11] 4,455,158

[45] Jun. 19, 1984

[54] NITROGEN REJECTION PROCESS INCORPORATING A SERPENTINE HEAT EXCHANGER

[75] Inventors: Harvey L. Vines, Emmaus; Miguel R. Alvarez, Allentown; Howard C. Rowles, Center Valley; Donald W. Woodward, New Tripoli, all of Pa.

[73] Assignee: Air Products and Chemicals, Inc., Allentown, Pa.

[21] Appl. No.: 477,561

[22] Filed: Mar. 21, 1983

[51] Int. Cl.[3] ..... F25J 1/02

[52] U.S. Cl. ..... 62/28; 62/30; 62/31; 62/34; 62/39

[58] Field of Search ..... 62/9, 11, 23–28, 62/33, 34, 40, 31, 36, 30; 165/122, 140, 166, 146

[56] References Cited

U.S. PATENT DOCUMENTS

| | | | |
|---|---|---|---|
| 2,869,835 | 1/1959 | Butt | 257/245 |
| 2,940,271 | 6/1960 | Jackson | 62/31 |
| 3,225,824 | 12/1965 | Wartenberg | 165/122 |
| 3,397,460 | 10/1965 | Hall | 34/20 |
| 3,731,736 | 5/1973 | Fernandes | 165/166 |
| 3,907,032 | 9/1975 | DeGroote et al. | 165/166 |
| 4,128,410 | 12/1978 | Bacon | 62/140 |
| 4,201,263 | 5/1978 | Anderson | 165/146 |
| 4,282,927 | 8/1981 | Simmons | 165/166 |

*Primary Examiner*—Frank Sever

*Attorney, Agent, or Firm*—Michael Leach; E. Eugene Innis; James C. Simmons

[57] ABSTRACT

A method is disclosed for cooling a multicomponent gas stream containing variable amounts of the components by passing the gas stream through a heat exchange relationship with a fluid coolant stream so that carry-up of the condensed phase is maintained without condensed phase backmixing over the compositional range of the multicomponent gas stream. The gas stream is cooled by passing it through a cold-end up heat exchanger having a serpentine pathway for the multicomponent gas stream comprising a series of horizontal passes separated by horizontal dividers and alternatingly connected by turnaround passes at each end, the cross-sectional area of at least one horizontal pass nearer the cold-end being less than the cross-sectional area of a horizontal pass nearer the warm-end. The method is particularly applicable to cooling a natural gas feed stream having a variable nitrogen content in a nitrogen rejection process.

15 Claims, 2 Drawing Figures

NITROGEN REJECTION PROCESS INCORPORATING A SERPENTINE HEAT EXCHANGER

TECHNICAL FIELD

The invention relates to a process for cooling a variable content, multicomponent gas stream over the range of its variable composition. More particularly, the invention relates to a nitrogen rejection process in which a natural gas feed stream having an increasing nitrogen content is cooled.

BACKGROUND OF THE INVENTION

Previously, nitrogen rejection from natural gas was confined to a naturally occurring nitrogen content, thus an essentially constant feed composition. Recent methods of tertiary oil recovery utilizing nitrogen injection/rejection concepts, however, necessitate nitrogen rejection units (NRU) that can process a feed gas stream of a widely varying composition because the associated gas from the well becomes diluted by increasing amounts of injected nitrogen as the project continues. In order to sell this gas, nitrogen must be removed since it reduces the gas heating value. These nitrogen rejection processes typically use conventional heat exchangers to effect cooling of the natural gas feed stream.

Countercurrent heat exchange is commonly used in cryogenic processes because it is relatively more energy efficient than crossflow heat exchange. Heat exchangers of the plate-fin variety which are typically used in these processes can be configured in either a "cold-end up" or a "cold-end down" arrangement. When two-phase heat exchange, i.e. partial condensation, is effected one approach is to use the cold-end up arrangement because "pool boiling" may occur in a cold-end down arrangement when one of the refrigerant streams comprises many components. Pool boiling degrades the heat transfer performance of the heat exchanger. Therefore a cold-end up arrangement is preferred. The design of such cold-end up exchangers must insure that at all points in the exchanger, the velocity of the vapor phase is high enough to carry along the liquid phase and to avoid internal recirculation, i.e. liquid backmixing which degrades the heat transfer performance of the exchanger.

However, in certain processes, such typical cold-end up heat exchangers are not adequate. There are particular problems in heat exchange situations associated with cryogenic plants for purifying natural gas streams having a variable nitrogen content. One such application in a nitrogen rejection process for which conventional heat exchange technology is inadequate involves a natural gas feed stream which must be totally condensed at one feed composition in the early years, but which must only be partially condensed in the later years when the nitrogen content in the natural gas feed stream is much higher. As the nitrogen content gradually increases over the years, the cooled natural gas feed stream proceeds from a totally condensed stream to a two-phase cooled stream in which the fraction of the vapor phase increases with time. In such nitrogen rejection processes there is no vapor to carry over the liquid in the early years, so that the use of a conventional cold-end up heat exchanger is problematical.

A worker of ordinary skill in the art of cryogenic processes can choose from a host of heat exchangers such as, for example, helically wound coil exchangers, shell and tube exchangers, plate-exchangers and others.

Illustrative of the numerous patents showing heat exchangers having a serpentine pathway for at least one fluid passing in a heat transfer relationship with another fluid are U.S. Pat. Nos. 2,869,835; 3,225,824; 3,397,460; 3,731,736; 3,907,032 and 4,282,927. None of these patents disclose the use of a serpentine heat exchanger to solve the problem of liquid backmixing associated with heat exchangers for cooling a natural gas feed stream having a variable content in a nitrogen rejection scheme.

U.S. Pat. No. 2,940,271 discloses the use of tube heat exchangers in a process scheme for the separation of nitrogen from natural gas. No mention is made of the problems associated with cooling a multicomponent variable content gas stream.

U.S. Pat. No. 4,128,410 discloses a gas treating unit that uses external refrigeration to cool a high pressure natural gas stream by means of a serpentine, cold-end down heat exchanger. Since the refrigerant extracts heat from the natural gas stream as the refrigerant courses through the serpentine pathway in the heat exchanger, there is no problem with a two-phase upward condensing circuit.

U.S. Pat. No. 4,201,263 discloses an evaporator for boiling refrigerant in order to cool flowing water or other liquids. The evaporator uses a sinuous path consisting of multiple passes on the water side of the exchanger, in which each successive pass has less area, so that the velocity of the water is increased from the first pass to the last pass.

Serpentine heat exchangers have also been used in air separation processes as a single phase subcooler, that is for cooling a liquid stream to a lower temperature without backmixing due to density differences. Another application involves supercritical nitrogen feed cooling in a nitrogen wash plant over a region of substantial change in fluid density.

SUMMARY OF THE INVENTION

The present invention involves the application of serpentine heat exchange to overcome the problem of liquid phase carry-up associated with cooling a multicomponent, variable content gas stream in upward flow.

The invention relates to a process for cooling a multicomponent gas stream which comprises passing the gas stream through an indirect heat exchange relationship with a fluid coolant stream to condense at least a portion of the multicomponent gas stream, i.e. yield a cooled multicomponent stream which is essentially condensed or comprises vapor phase and liquid phase fractions depending upon the particular composition of the gas stream. The invention provides a method for cooling a multicomponent gas stream containing variable amounts of the components over its whole range of compositions so that carry-up of the condensed phase is maintained without condensed phase backmixing. The method comprises passing the multicomponent gas stream through a cold-end up heat exchanger having a serpentine pathway for the multicomponent gas stream comprising a series of horizontal passes, the cross-sectional area of at least one horizontal pass nearer the cold-end being less than the cross-sectional area of a horizontal pass nearer the warm end. This method achieves upward stable flow, especially two-phase flow, throughout the compositional range of the gas stream.

At least one coolant stream is passed through the heat exchanger in a cross- or countercurrent-flow to effect the indirect heat transfer.

Such serpentine heat exchange builds in pressure drop for an upwardly moving stream and insures that upward stability can be achieved at all points in the exchanger regardless of whether the cooled multicomponent gas stream is essentially totally condensed or comprises various amounts of gas phase and liquid phase fractions.

By means of the serpentine design, the multicomponent stream is forced alternatively across and back in turnaround passes moving from one horizontal crosspath to the next. The turnaround passes allow for high velocity and high local pressure drop to insure that liquid from one crosspath does not flow back into the crosspath below. Thus by building extra pressure drop into the multicomponent gas stream as it moves upward through the heat exchanger, the problem associated with carry over of liquid phase is alleviated.

Examples of gas streams that can be cooled in accordance with the process of the invention include multicomponent natural gas streams comprising methane, ethane and other light hydrocarbons with variable amounts of nitrogen ranging up to about 90%. The nitrogen content may, at some point, be near zero.

Other examples might be encountered in processing of petrochemical or refinery gas mixtures comprising methane and other light hydrocarbons with variable amounts of hydrogen ranging from about 20% up to 90%. In a process to recover a hydrogen-rich vapor product by partial condensation of the hydrocarbons, the fraction of the condensed liquid phase would vary according to the hydrocarbon content of the feed mixture. The variation may be cyclic or random depending on the source of the feed. A heat exchanger of serpentine design would alleviate the problem associated with liquid phase carry over.

DETAILED DESCRIPTION OF THE INVENTION

Figure 1:
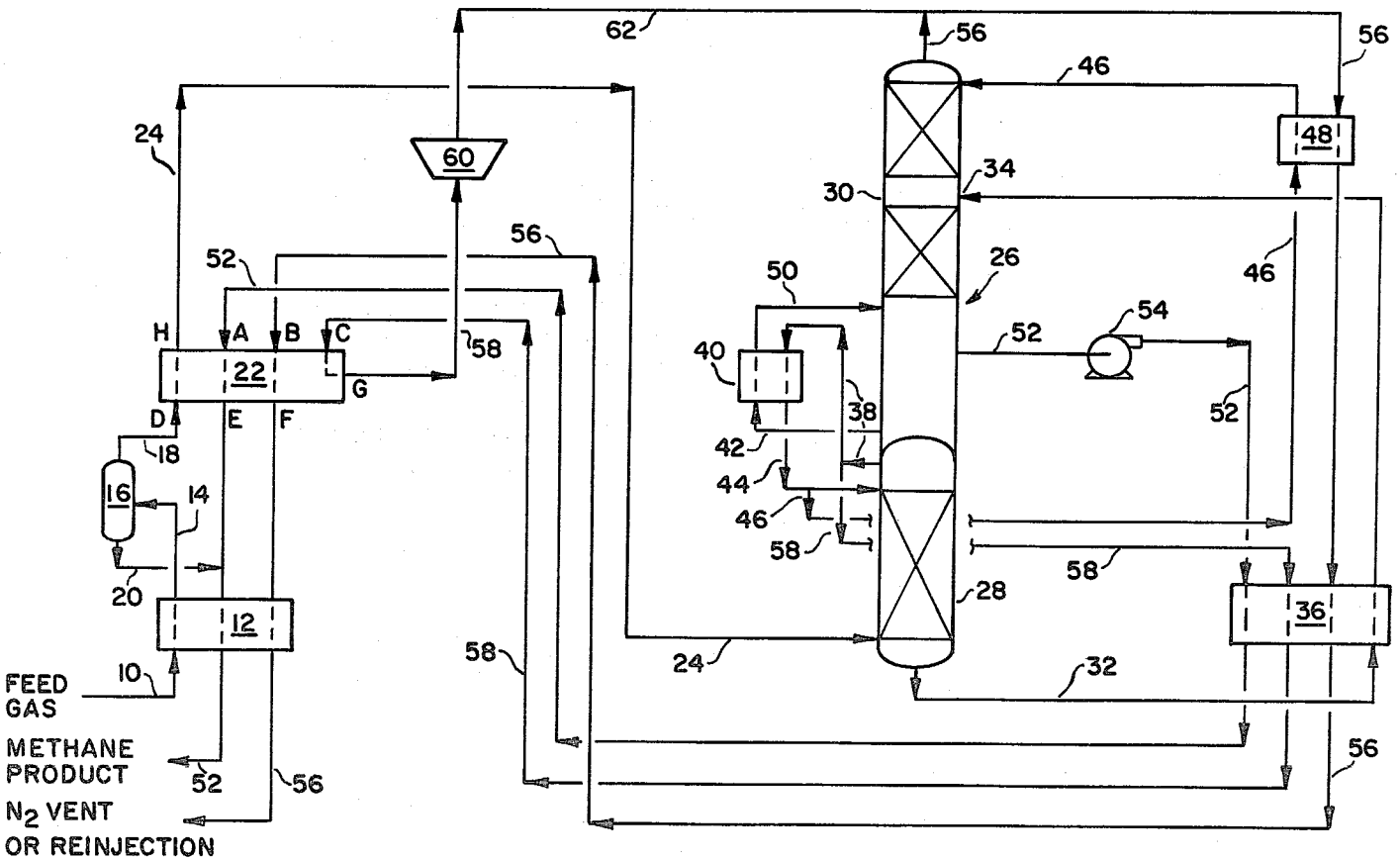
FIG. 1 is a flow diagram of an embodiment of the invention as applied to a nitrogen rejection process.

The method of the invention is applicable to a cryogenic nitrogen rejection process for a natural gas feed stream having a nitrogen content which process comprises cooling the natural gas feed stream through a heat transfer relationship with a fluid coolant stream to yield a cooled feed stream which, depending upon the composition of the natural gas feed stream, is essentially condensed or comprises various amounts of vapor phase and liquid phase fractions. The cooled feed stream is subsequently separated into a waste nitrogen stream and a methane product stream, for example in a double column distillation process.

A serpentine heat exchange relationship is provided for the two-phase condensing upward flow circuit in the cryogenic process for nitrogen rejection from natural gas. The method of the invention provides for cooling a natural gas feed stream containing variable amounts of methane, nitrogen and ethane-plus hydrocarbons which comprises passing the natural gas feed stream through a cold-end up heat exchanger having a serpentine pathway for the feed stream comprising a series of horizontal passes separated by horizontal dividers and alternatingly connected by turnaround passes at each end, the cross-sectional area of horizontal passes near the cold-end being less than the cross-sectional area of horizontal passes near the warm end so that carry-up of the condensed phase is maintained without liquid phase backmixing. The natural gas feed stream is cooled through a heat transfer relationship with at least one fluid coolant stream which may be passing in a countercurrent-flow or crossflow with the overall flow of the feed stream.

It is critical that the cross-sectional area of the horizontal crosspasses be as described above in order to achieve sufficient pressure drop to prevent backmixing for the complete condensation situation while minimizing pressure drop for the partial condensation case.

In a heat exchanger in which the cross-section of the serpentine pathway is a rectangle and the depth of the pathway is constant, it is the height of the horizontal passes nearer the cold-end which must be less than the height of the horizontal passes nearer the warm-end. Thus, the use of either "cross-sectional area" or "height" when referring to horizontal passes implies the other.

As a result, the use of a serpentine heat exchange relationship for cooling the natural gas feed stream in a nitrogen rejection process eliminates the need to place a conventional plate-fin heat exchanger in a cold-end down or crossflow configuration which is disadvantageous. A cold-end down configuration would result in a less efficient process as a result of the liquid phase carry-up and backmixing problems of the refrigerant stream. Thus, the method of the invention results in greater efficiency and operability of natural gas processing plants for nitrogen rejection.

A process for treating a natural gas stream containing methane, nitrogen and ethane-plus hydrocarbons in variable amounts which incorporates the method of the invention will now be described with reference to FIG. 1.

The natural gas feed stream in line 10 will have been treated initially in a conventional dehydration and carbon dioxide removal step to provide a dry feed stream containing carbon dioxide at a level which will not cause freeze-out on the surfaces of the process equipment. The natural gas feed stream in line 10 at about 41° C. and 28 atm is passed through heat exchanger 12 where it partially condenses to provide stream 14 containing vapor and liquid phases. In separator 16 these phases are separated to provide a vapor phase stream 18 comprising nitrogen, methane and ethane-plus hydrocarbons while condensed phase stream 20 comprises some of the ethane-plus hydrocarbons which were present in the natural gas feed stream.

Vapor phase stream 18 is cooled in serpentine heat exchanger 22 through a heat exchange relationship against methane product stream 52, nitrogen waste stream 56 and high pressure nitrogen stream 58. The nitrogen and methane-containing vapor stream 18 courses the sinuous pathway of cold-end up serpentine heat exchanger 22, which is described in more detail hereinafter, exiting as cooled feed stream 24 for separation into its nitrogen and methane components in a conventional double distillation column 26 which comprises high pressure distillation zone 28 and low pressure distillation zone 30. The cooled feed stream 24 enters high pressure distillation zone 28 near the sump and is separated into a methane-rich bottoms and a nitrogen rich overhead. A bottoms stream 32 is withdrawn from the high pressure distillation zone 28 and is charged to low pressure distillation zone 30 at an intermediate level 34 after being cooled by passing through heat exchanger 36 and expanded to the lower pressure. The nitrogen overhead from high pressure column 28 passes by line 38 through heat exchanger 40 which functions as a reboiler/condenser.

In heat exchanger 40 the heat value given up by the nitrogen overhead stream in line 38 is used to provide reboil for the bottoms stream 42 which is withdrawn from low pressure distillation zone 30. The cooled nitrogen overhead stream emerging from heat exchanger 40 contains condensate which is conveyed in line 44 back into the top of high pressure distillation zone 28 as reflux. A portion of the condensed nitrogen from line 44 passes by line 46 for further cooling in heat exchanger 48 after which it is expanded and injected into the top of low pressure distillation zone 30.

Low pressure distillation zone 30 is operated to provide a liquid methane bottoms and an overhead which is essentially nitrogen. Reboiling for the bottoms is provided by withdrawing a bottoms stream in line 42 and passing it through heat exchanger 40 where it absorbs heat from the nitrogen overhead stream in line 38 from the high pressure distillation zone 28. The partially vaporized bottoms stream 50 re-enters low pressure distillation zone 30 as reboil. A liquid methane product stream 52 is withdrawn from the bottom of low pressure distillation zone 30 and is passed through liquid methane pump 54. The liquid methane stream is pumped in line 52 through heat exchangers 36, 22 and 12 in which the stream is warmed to provide a methane product stream.

The cold nitrogen overhead from the low pressure distillation zone 30 passes in line 56 as exhaust through heat exchanger 48 where it is warmed by absorbing heat from the condensed nitrogen overhead from high pressure distillation column 28. The nitrogen exhaust in line 56 is further warmed by consecutive passage through heat exchangers 36, 22 and 12 to provide refrigeration for the process whereupon it is rejected to the atmosphere or possibly reinjected into a well.

When the natural gas feed stream comprises about 33% or more nitrogen, excess nitrogen vapor in line 58 which branches off line 38 from the high pressure distillation column 28 is warmed by passage through heat exchangers 36 and 22, and then is expanded through nitrogen expander 60 to supply cold-end refrigeration for the double distillation column 26. The low pressure discharge in line 62 from nitrogen expander 60 combines with the substantially pure nitrogen in line 56 from the top of low pressure distillation zone 30 to form the waste nitrogen stream.

Figure 2:
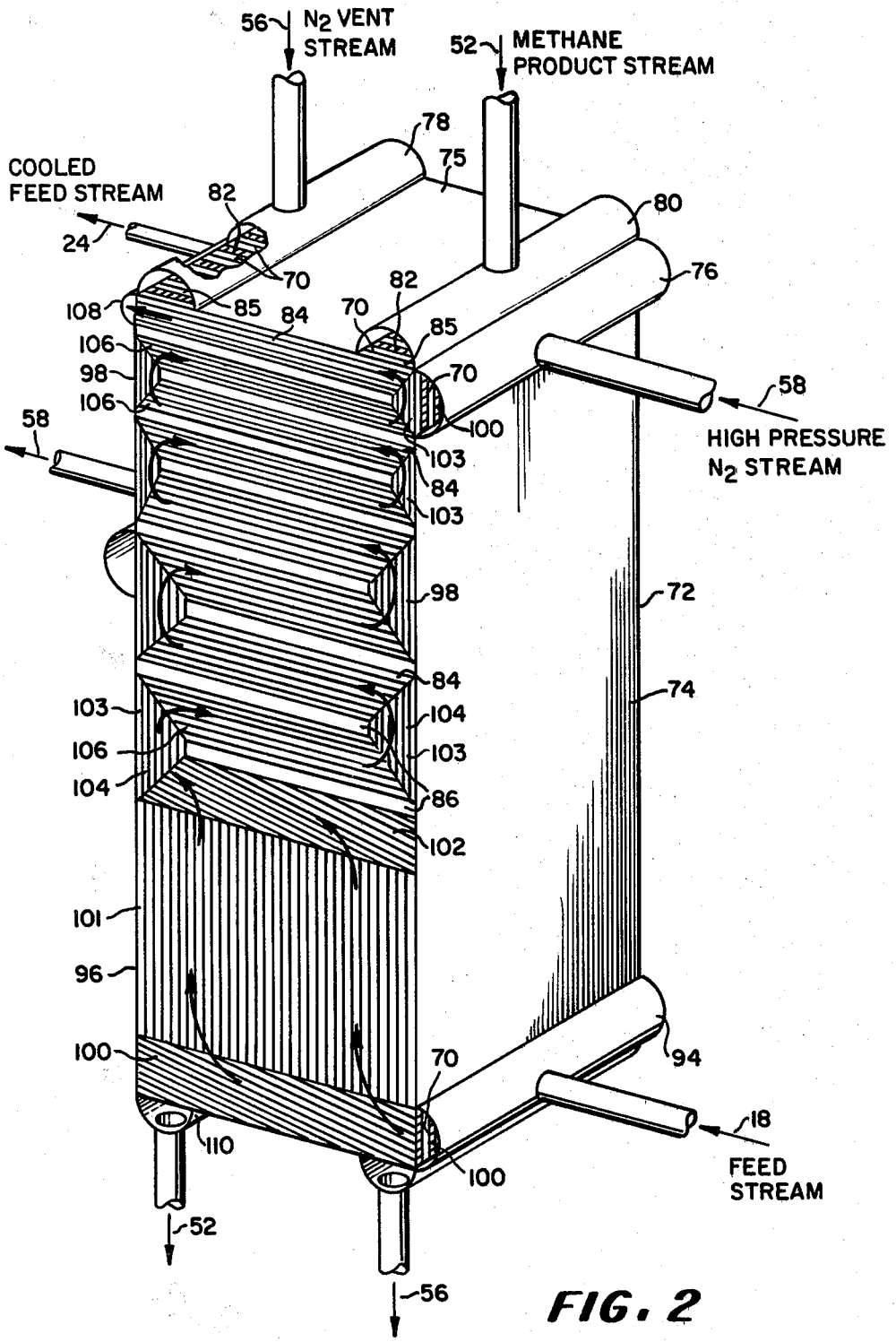
FIG. 2 is a perspective view with parts broken away to show the internal structure of a preferred serpentine heat exchanger for the inventive method as applied to the nitrogen rejection process of FIG. 1.

FIG. 2 shows a preferred serpentine heat exchanger for use in the above-described nitrogen rejection process.

As shown in FIG. 2, the heat exchanger is essentially rectangular with a plurality of vertical parallel plates 70 of substantially the same dimensions as the front and backwalls 72 positioned within the exchanger for the entire length of sidewalls 74. It is preferred that the plates 70 be of a metal such as aluminum having good heat transfer characteristics and capable of withstanding low temperatures. Extending across the top of the heat exchanger for its full depth is top wall 75 and two parallel tunnel-shaped headers 78 and 80, the nitrogen vent header and the methane product header, respectively. Also extending across the top of each sidewall 74 are the high pressure nitrogen header 76 and the cooled feed stream outlet header 108 adjacent header 80 and 78, respectively.

In the space between some of the vertical plates 70 are corrugated metallic inserts 82 having their ridges running vertically through the heat exchanger. In the space between other plates 70 are corrugated inserts 84 having their ridges extending horizontally through the heat exchanger. Inserts 82 and 84 may comprise plate fins, such as perforated, serrated and herringbone plate fins. The inserts 82 and 84 are in alternate spaces between plates 70 in each vertical section of heat exchanger 22. The inserts act as distributors for fluids flowing through the heat exchanger and aid in the conduction of heat to or from the plates 70. Closing off the spaces between vertical plates 70 which do not contain inserts 82 are covers 85. Although not depicted in FIG. 2, vertical inserts 82 also comprise a distribution section which provides diagonal pathways leading from the headers 76, 78 and 80 and spreading over the entire width of the spaces between plates 70 thereby distributing the feed streams from the headers throughout the width of the exchanger. Alternatingly extending from each sidewall 74 through most of the space between plates 70 in which there are inserts 84 are horizontal dividers 86 which guide the natural gas feed stream through the heat exchanger in a series of horizontal passes, as hereinafter described.

The distance between top wall 75 and horizontal divider 86 defining the upper most horizontal pass 106, i.e. the pass nearest the cold-end, is less than the distance between the bottom two horizontal dividers 86 defining the horizontal pass nearest the warm-end. The uppermost horizontal pathway 106 of the serpentine pathway discharges into feed stream outlet header 108 which is connected to line 24. Preferably, of the total horizontal passes composing the serpentine pathway about 50% of the horizontal passes are smaller in height and nearer the cold-end.

On the lower end of the heat exchanger is a feed stream header 94 which directs the natural gas feed stream into the cooling section 96 connected to the sinuous pathway, generally designated as 98, at its lower warm-end, i.e. upstream of the sinuous pathway. Cooling section 96 comprises the alternating spaces between plates 70 having distributor fins or panels 100, which connect inlet feed stream header 94 with vertical inserts 101 of cooling section 96, and distributor panels 102 which connect vertical inserts 101 with first internal turnaround section 103 containing vertical panels 104. Vertical panels 104 comprise plate-fins which, preferably, are perforated. Thus a substantially vertical cooling pathway is provided for the natural gas feed stream 18 prior to entering the serpentine section where condensation occurs.

A methane product outlet header 110 across the bottom of the heat exchanger seals against the sidewall and the bottom of the heat exchanger. The methane product stream is delivered for warming in the heat exchanger through line 52 from the double distillation column into those spaces between plates 70 having inserts 82 permitting flow vertically from inlet header 80 to outlet header 110.

Natural gas feed enters the heat exchanger through line 18 and header 94 and flows through the spaces between plates 70 in which there are distributor fins 100, vertical inserts 101, distributor fins 102, vertical inserts 104 in turnarounds 103, and horizontally ridged inserts 84. The feed stream flows diagonally upward across the heat exchanger between distributor fins 100, then vertically through vertical inserts 101 and diagonally upward again between distributor fins 102 into the first, or lower most, turnaround 103. Since the vertical inserts 104 of each turnaround 103 angularly connect with the horizontal inserts 84, the effect on the feed stream is to reverse its horizontal flow direction in each turnaround 103 while also advancing vertically. Thus, the overall flow of the natural gas feed stream is vertical from line 18 to line 24 and is countercurrent to the flow of the methane product stream and waste nitrogen stream, but the vertical flow is accomplished in part in a series of horizontal passes 106 in a crossflow manner.

Waste nitrogen 56 from the low pressure zone 30 flows into header 78 and downwardly through spaces having vertically ridged inserts 82 between plates 70 and is discharged as nitrogen vent or is reinjected into a well. Since the overall flow of the feed stream is vertically upward, the waste nitrogen gas and the feed stream flow countercurrently through the heat exchanger. Similarly, the methane product stream from low pressure zone 30 flows from header 80 downwardly through the exchanger; consequently, that flow is also countercurrent with the flow of the feed stream. If the nitrogen content of the feed stream is above about 33% in this example, then a high pressure nitrogen stream in line 58 enters the heat exchanger via header 76 and flows downwardly through the spaces between plates 70 in which there are vertically rigid inserts 82. The feed stream, therefore, extracts heat from the methane product stream, the waste nitrogen stream and the high pressure nitrogen stream to lower its temperature from the temperature in line 18 to the temperature in line 24.

Of critical importance to the invention is the height of the horizontal, or cross, passes 106. The height of at least one horizontal pass 106 defined by horizontal dividers 86 at the cold end must be less than the height of the horizontal passes 106 nearer the warm end. Of the total number of horizontal passes composing the serpentine pathway, preferably 25 to 75% of them should have a smaller height toward the cold end. The height of the smaller horizontal passes may be 25 to 75% the height of the larger horizontal passes, preferably 40 to 60%.

As should be obvious to a worker skilled in the art, inverting the above described serpentine heat exchanger would permit boiling a multicomponent refrigerant stream in an upward flow scheme, i.e. cold-end down. However, the penalty imposed by high serpentine pressure drop in a low pressure refrigerant stream in cold-end down application would be more severe than in a high pressure feed stream which is cold-end up.

In the following examples showing the nitrogen rejection from a variable content natural gas stream at various nitrogen concentrations, the data presented were calculated based on a serpentine heat exchanger as shown in FIG. 2 being 240 inches overall length (divided equally between the serpentine section 98 and the cooling section 96), 36 inches width and 48 inches stacking height. The serpentine pathway comprises 24 sinuous passages between plates 70 each sinuous passage having eight horizontal passes, the upper four being 9 inches high and the remaining four being 19 inches high, i.e. the four upper passes are about 50% the height of the four lower passes. The number of vertical passages between plates 70 provided in the heat exchanger for the three coolant streams are the following: 54 passages for the methane product stream 52, 42 passages for the nitrogen vent stream 56, and 12 passages for the high pressure nitrogen stream 58. It should be noted that the vertical passages for the high pressure nitrogen stream do not run the entire height of the heat exchanger, rather terminating about 72 inches from the top.

EXAMPLE 1

Tabulated in Table 1 are the calculated overall balances corresponding to the heat and material balance points A, B, D, E, F and H as designated in FIG. 1. In this case the natural gas feed stream contains an amount of nitrogen (21%) such that the entire feed stream is condensed in the serpentine heat exchanger and there is no high pressure nitrogen stream 58.

TABLE 1

| STREAM | *A | *B | *D | E | F | H |
|---|---|---|---|---|---|---|
| STREAM NAME | C1 PROD | N2 VENT | FEED | C1 PROD | N2 VENT | FEED |
| PRESSURE PSIA | 168.00 | 23.80 | 385.00 | 163.00 | 23.30 | 370.00 |
| TEMPERATURE DEG, F. | −237.74 | −237.74 | −40.00 | −55.00 | −55.00 | −226.76 |
| LIQ. DENSITY, LB/CUFT | 30.0 | 0.0 | 0.0 | 0.0 | 0.0 | 31.43 |
| VAP. DENSITY, LB/CUFT | 0.0 | 0.28 | 2.10 | 0.81 | 0.15 | 0.0 |
| FLOW RATES MOLES/HR | | | | | | |
| NITROGEN | 91.23 | 343.32 | 434.55 | 91.23 | 343.32 | 434.55 |
| METHANE | 1257.29 | 9.11 | 1266.40 | 1257.29 | 9.11 | 1266.40 |
| ETHANE-PLUS | 344.42 | 0.0 | 344.42 | 344.42 | 0.00 | 344.42 |
| CARBON DIOXIDE | 0.04 | 0.00 | 0.04 | 0.04 | 0.00 | 0.04 |
| TOTAL FLOW MOL/HR | 1692.98 | 352.43 | 2045.41 | 1692.98 | 352.43 | 2045.41 |
| | LIQ | VAP | VAP | VAP | VAP | LIQ |

*INDICATES INPUT STREAM

EXAMPLE 2

In this case the natural gas feed stream contains about 45% nitrogen resulting in a two phase feed stream exiting the serpentine heat exchanger. Table 2 shows the calculated overall heat and material balance for points A–H.

TABLE 2

| STREAM | *A | *B | *C | *D | E | F | G | H |
|---|---|---|---|---|---|---|---|---|
| TOTAL LIQUID VAPOR | | | | | | | | |
| STREAM NAME | C1 PROD | N2 VENT | HP N2 | FEED | C1 PROD | N2 VENT | HP N2 | FEED |

TABLE 2-continued

| STREAM | *A | *B | *C | *D | E | F | G | H |
|---|---|---|---|---|---|---|---|---|
| PRESSURE PSIA | 148.00 | 26.00 | 220.00 | 380.00 | 143.00 | 24.50 | 218.00 | 365.00 |
| TEMPERATURE DEG, F. | −241.81 | −241.81 | −241.81 | −65.00 | −84.59 | −84.59 | −218.00 | −214.49 |
| FLOW RATES MOLES/HR | | | | | | | | |
| NITROGEN | 214.04 | 1362.61 | 543.68 | 1576.65 | 214.04 | 1362.61 | 543.68 | 1576.65 |
| METHANE | 1487.92 | 8.21 | 6.32 | 1496.13 | 1487.92 | 8.21 | 6.32 | 1496.13 |
| ETHANE-PLUS | 400.27 | 0.00 | 0.00 | 400.27 | 400.27 | 0.00 | 0.00 | 400.27 |
| CARBON DIOXIDE | 0.02 | 0.00 | 0.00 | 0.02 | 0.02 | 0.00 | 0.00 | 0.02 |
| TOTAL FLOW MOL/HR | 2102.25 | 1370.83 | 550.00 | 3473.08 | 2102.25 | 1370.83 | 550.00 | 3473.08 |
| LIQ. DENSITY, LB/CUFT | 30.89 | 0.0 | 0.0 | 0.0 | 34.57 | 0.0 | 0.0 | 32.39 |
| FLOW RATES MOLES/HR | | | | | | | | |
| NITROGEN | 214.04 | 0.0 | 0.0 | 0.0 | 0.06 | 0.0 | 0.0 | 1180.91 |
| METHANE | 1487.92 | 0.0 | 0.0 | 0.0 | 3.67 | 0.0 | 0.0 | 1412.93 |
| ETHANE-PLUS | 400.27 | 0.0 | 0.0 | 0.0 | 29.90 | 0.0 | 0.0 | 399.39 |
| CARBON DIOXIDE | 0.02 | 0.0 | 0.0 | 0.0 | 0.00 | 0.0 | 0.0 | 0.02 |
| TOTAL LIQ. MOL/HR | 2102.25 | 0.0 | 0.0 | 0.0 | 33.63 | 0.0 | 0.0 | 2993.24 |
| VAP. DENSITY, LB/CUFT | 0.0 | 0.32 | 3.30 | 2.37 | 0.77 | 0.17 | 2.72 | 5.25 |
| FLOW RATES MOLES/HR | | | | | | | | |
| NITROGEN | 0.0 | 1362.61 | 543.68 | 1576.65 | 213.98 | 1362.61 | 543.68 | 395.75 |
| METHANE | 0.0 | 8.21 | 6.32 | 1496.13 | 1484.25 | 8.21 | 6.32 | 83.20 |
| ETHANE-PLUS | 0.0 | 0.00 | 0.00 | 400.27 | 370.37 | 0.00 | 0.00 | 0.88 |
| CARBON DIOXIDE | 0.0 | 0.00 | 0.00 | 0.02 | 0.02 | 0.00 | 0.00 | 0.00 |
| TOTAL VAPOR MOL/HR | 0.0 | 1370.83 | 550.00 | 3473.08 | 2068.62 | 1370.83 | 550.00 | 479.83 |

*INDICATES INPUT STREAM

EXAMPLE 3

This case again shows the formation of a two phase cooled feed stream exiting the serpentine heat exchanger in which the natural gas feed stream has a very high nitrogen content of about 75%. Table 3 gives the calculated overall heat and material balances for the designated points.

TABLE 3

| STREAM | *A | *B | *C | *D | E | F | G | H |
|---|---|---|---|---|---|---|---|---|
| TOTAL LIQUID VAPOR | | | | | | | | |
| STREAM NAME | C1 PROD | N2 VENT | HP N2 | FEED | C1 PROD | N2 VENT | HP N2 | FEED |
| PRESSURE PSIA | 128.00 | 31.00 | 217.00 | 375.00 | 123.00 | 27.00 | 214.00 | 350.00 |
| TEMPERATURE DEG, F. | −256.12 | −256.12 | −256.12 | −110.00 | −128.22 | −128.22 | −220.00 | −226.84 |
| FLOW RATES MOLES/HR | | | | | | | | |
| NITROGEN | 159.27 | 2923.52 | 1195.69 | 3082.79 | 159.27 | 2923.52 | 1195.69 | 3082.79 |
| METHANE | 739.88 | 6.94 | 4.31 | 746.83 | 739.88 | 6.94 | 4.31 | 746.83 |
| ETHANE-PLUS | 167.60 | 0.00 | 0.00 | 167.60 | 167.60 | 0.00 | 0.00 | 167.60 |
| CARBON DIOXIDE | 0.02 | 0.00 | 0.00 | 0.02 | 0.02 | 0.00 | 0.00 | 0.02 |
| TOTAL FLOW MOL/HR | 1066.76 | 2930.47 | 1200.00 | 3997.23 | 1066.76 | 2930.47 | 1200.00 | 3997.23 |
| LIQ. DENSITY, LB/CUFT | 31.94 | 0.0 | 0.0 | 0.0 | 33.70 | 0.0 | 0.0 | 34.93 |
| FLOW RATES MOLES/HR | | | | | | | | |
| NITROGEN | 159.27 | 0.0 | 0.0 | 0.0 | 0.39 | 0.0 | 0.0 | 774.81 |
| METHANE | 739.88 | 0.0 | 0.0 | 0.0 | 16.06 | 0.0 | 0.0 | 481.96 |
| ETHANE-PLUS | 167.60 | 0.0 | 0.0 | 0.0 | 79.76 | 0.0 | 0.0 | 163.89 |
| CARBON DIOXIDE | 0.02 | 0.0 | 0.0 | 0.0 | 0.00 | 0.0 | 0.0 | 0.01 |
| TOTAL LIQ. MOL/HR | 1066.76 | 0.0 | 0.0 | 0.0 | 96.21 | 0.0 | 0.0 | 1420.67 |
| VAP. DENSITY, LB/CUFT | 0.0 | 0.41 | 3.77 | 2.88 | 0.72 | 0.21 | 2.70 | 5.65 |
| FLOW RATES MOLES/HR | | | | | | | | |
| NITROGEN | 0.0 | 2923.52 | 1195.69 | 3082.79 | 158.88 | 2923.52 | 1195.69 | 2307.98 |
| METHANE | 0.0 | 6.94 | 4.31 | 746.83 | 723.82 | 6.94 | 4.31 | 264.87 |
| ETHANE-PLUS | 0.0 | 0.00 | 0.00 | 167.60 | 87.84 | 0.00 | 0.00 | 3.71 |
| CARBON DIOXIDE | 0.0 | 0.00 | 0.00 | 0.02 | 0.01 | 0.00 | 0.00 | 0.00 |
| TOTAL VAPOR MOL/HR | 0.0 | 2930.47 | 1200.00 | 3997.23 | 970.54 | 2930.47 | 1200.00 | 2576.56 |

*INDICATES INPUT STREAM

From the above description of a preferred embodiment of the invention for cooling a variable content multicomponent gas stream to provide at least some condensed phase, it can be seen that a method is disclosed for providing the necessary pressure drop and minimum gas velocity to carry condensed phase upwardly through a cold-end up heat exchange relationship with at least one coolant fluid stream. By the use of cold-end up serpentine heat exchangers having a sinuous pathway for the multicomponent gas stream which is to be cooled, the problem of carry-up is only encountered in the turnaround passes, not in the horizontal passes, thus reducing the carry-up problem to a small fraction of the total cooling pathway in which condensation occurs and rendering it manageable. As a further advantage of the serpentine heat exchanger shown and described above a preliminary cooling of the multicomponent gas stream is effected in the vertical passes prior to entering the serpentine section of the heat exchanger.

STATEMENT OF INDUSTRIAL APPLICATION

The invention provides a method for maintaining upward stability of a multicomponent gas stream as it is cooled through a cold-end up heat exchange relationship with a coolant stream whereby backflow of condensate is avoided. The method of the invention has particular application to cooling of a variable content, natural gas feed stream in a nitrogen rejection process.

We claim:

1. In a process for cooling a multicomponent gas stream containing variable amounts of the components which comprises passing the gas stream through a heat exchange relationship with a fluid coolant stream to condense at least a portion of the multicomponent gas stream, the method for maintaining carry-up of the condensed phase without condensed phase backmixing over the compositional range of the multicomponent gas stream which comprises passing the multicomponent gas stream through a serpentine pathway comprising a series of horizontal passes, the cross-sectional area of at least one horizontal pass nearer the cold-end being less than the cross-sectional area of the horizontal passes nearer the warm-end, the serpentine pathway being in a cold-end up heat exchange relationship with the fluid coolant stream.

2. The method of claim 1 wherein the number of horizontal passes nearer the cold-end having a lesser cross-sectional area compose 25 to 75% of the total number of horizontal passes.

3. The method of claim 2 wherein about 50% of the horizontal passes are of lesser cross-sectional area and nearer the cold-end.

4. The method of claim 1 wherein the the multicomponent gas stream is first passed through a cooling section having vertical passages in a heat exchange relationship with the fluid coolant stream and fluidly connected at its outlet to the warm end of the serpentine pathway.

5. The method of claim 1 wherein at least one horizontal pass nearer the cold-end is 25 to 75% the cross-sectional area of the horizontal passes nearer the warm-end.

6. The method of claim 1 wherein at least one horizontal pass nearer the cold-end is about 50% the cross-sectional area of the horizontal passes nearer the warm-end.

7. In a cryogenic nitrogen rejection process for a natural gas feed stream containing nitrogen, methane and ethane-plus hydrocarbons which comprises cooling the natural gas feed stream through a heat transfer relationship with a fluid coolant stream to condense at least a portion of the feed stream and separating the cooled feed stream into a waste nitrogen stream and a methane product stream, the method for treating a natural gas feed stream containing a variable composition so that carry-up of the condensed phase is maintained without liquid phase backmixing, which method comprises passing the natural gas feed stream through a serpentine pathway comprising a series of horizontal passes, the cross-sectional area of at least one horizontal pass nearer the cold-end being less than the cross-sectional area of the horizontal passes nearer the warm end, the serpentine pathway being in a cold-end up heat exchange relationship with the fluid coolant stream.

8. The method of claim 7 wherein the number of horizontal passes nearer the cold-end having a lesser cross-sectional area compose 25 to 75% of the total number of horizontal passes.

9. The method of claim 8 wherein about 50% of the horizontal passes are of lesser cross-sectional area and nearer the cold-end.

10. The method of claim 7 wherein the coolant stream is selected from a methane product stream, a waste nitrogen stream and a high pressure nitrogen stream.

11. The method of claim 7 wherein the the natural gas stream is first passed through a cooling section having vertical passages in a heat exchange relationship with the fluid coolant stream and fluidly connected at its outlet to the warm end of the serpentine pathway.

12. The method of claim 11 wherein the natural gas stream contains up to about 90% nitrogen.

13. The method of claim 7 wherein at least one horizontal pass nearer the cold-end is 25 to 75% the cross-sectional area of the horizontal passes nearer the warm-end.

14. The method of claim 7 wherein at least one horizontal pass nearer the cold-end is about 50% the cross-sectional area of the horizontal passes nearer the warm-end.

15. In a nitrogen rejection unit comprising a heat exchanger for cooling a nitrogen containing natural gas stream against a coolant stream and a double distillation column having a high pressure distillation zone and a low pressure distillation zone for separating the cooled natural gas stream from the heat exchanger into a nitrogen stream and a methane stream, the improvement comprising a cold-end up heat exchanger having a serpentine pathway for the natural gas stream for cooling and condensing at least a portion of the natural gas stream in an overall upward flow against the nitrogen stream or the methane stream, which serpentine pathway comprises a series of horizontal passes separated by horizontal dividers and alternatingly connected by turn-around passes at each end, the cross-sectional area of at least one horizontal pass nearer the cold-end being less than the cross-sectional area of the horizontal passes near the warm-end so that carry-up of the condensed phase of the natural gas stream is maintained without condensed phase backmixing.

* * * * *